US008043073B2

(12) United States Patent
Meyknecht

(10) Patent No.: US 8,043,073 B2
(45) Date of Patent: Oct. 25, 2011

(54) MICROPUMP AND ADHESIVE-FREE METHOD FOR JOINING TWO SUBSTRATES

(75) Inventor: Ron Meyknecht, Munster (DE)

(73) Assignee: Bartels Mikrotechnik GmbH, Dortmund (DE)

( * ) Notice: Subject to any disclaimer, the term of this patent is extended or adjusted under 35 U.S.C. 154(b) by 495 days.

(21) Appl. No.: 10/569,435

(22) PCT Filed: Dec. 20, 2004

(86) PCT No.: PCT/EP2004/014505

§ 371 (c)(1), (2), (4) Date: Feb. 23, 2006

(87) PCT Pub. No.: WO2005/061894

PCT Pub. Date: Jul. 7, 2005

(65) Prior Publication Data

US 2007/0003420 A1 Jan. 4, 2007

(30) Foreign Application Priority Data

Dec. 19, 2003 (DE) ..... 103 60 709

(51) Int. Cl.
*F04B 17/00* (2006.01)

(52) U.S. Cl. ..... 417/413.2; 417/413.1; 137/855

(58) Field of Classification Search ..... 417/413.2, 417/413.1, 413.3, 565; 137/855
See application file for complete search history.

(56) References Cited

U.S. PATENT DOCUMENTS 6,644,944 B2 * 11/2003 Karp ..... 417/566
2002/0155010 A1 * 10/2002 Karp et al. ..... 417/413.2
2002/0168278 A1 * 11/2002 Jeon et al. ..... 417/559

* cited by examiner

*Primary Examiner* — Charles Freay
*Assistant Examiner* — Todd D Jacobs
(74) *Attorney, Agent, or Firm* — Kubotera & Associates, LLC

(57) ABSTRACT

The invention relates to a device provided with channel-type structures for transporting and/or storing a liquid and/or gaseous medium. The device comprises a first (1) substrate layer and a second substrate layer (2), and a functional element (3) that is sandwiched between the first and second substrate layers, the channel-type structures being embodied in the first and/or second substrate layer. The first and second substrate layers are solidly and permanently interconnected, and the functional element is clamped between the first and second substrate layers. The functional element is elastic, the first and second layers are rigid, and the channel-type structures in the first and/or second substrate layers are at least partially sealed in a gas-tight and/or liquid-tight manner due to the functional element.

7 Claims, 10 Drawing Sheets

MICROPUMP AND ADHESIVE-FREE METHOD FOR JOINING TWO SUBSTRATES

The present invention relates to an adhesive-free method for joining two substrates and in particular to a micropump which has been produced in particular by means of the adhesive-free method for joining two substrates.

The prior art has disclosed a wide range of methods for joining a first, second and third substantially two-dimensional layer in particular made from plastic and/or glass and/or substrate and/or metal to one another. By way of example, the first, second and third layers can be joined to one another by means of adhesives, in which case the methods which are known from the prior art in each case use three layers which are of substantially equal size in terms of the extent of their area.

Moreover, the prior art has disclosed micropumps which substantially comprise a housing lower part and a housing upper part, between which there is arranged a valve diaphragm, cf. for example DE-19720482 C2.

The methods for joining three layers which are known from the prior art are generally very complex and expensive, and this equally also applies to the micropumps which are known from the prior art and are produced by the said methods.

Therefore, it is an object of the present invention to provide a micropump of compact design with a high pumping capacity which can be produced even in large numbers using simple and inexpensive production and joining techniques. A further object of the present invention is to provide an inexpensive method for producing a micromechanical component which substantially comprises a two-layer structure with a functional element between the two layers.

The objects are achieved by the features of the independent claims. Advantageous embodiments of the present invention are described in the subclaims and/or the following description, which is accompanied by diagrammatic drawings, in which:

FIGS. 1*a, b, c* and *d* diagrammatically depict the basic elements of an apparatus according to the invention;

FIGS. 2*a, b* and *c* each show modifications to the apparatus according to the invention shown in FIG. 1;

FIG. 3*a* shows a diagrammatic plan view of the main components of an apparatus according to the invention in accordance with a first embodiment of the present invention, and FIG. 3*b* shows a section through components from FIG. 3*a* arranged on top of one another;

FIG. 4*a* shows a partial section through components of an apparatus according to the invention, arranged on top of one another, in accordance with a second embodiment of the present invention, and FIGS. 4*b* and *c* show diagrammatic plan views of a functional element of the second embodiment of the present invention from FIG. 4*a;*

FIG. 5*a* shows a diagrammatic partial section through components of an apparatus according to the invention, arranged on top of one another, in accordance with a third embodiment of the present invention, and FIGS. 5*b* and 5*c* show diagrammatic plan views of a functional element of the third embodiment of the present invention from FIG. 5*a;*

FIG. 6*a* diagrammatically depicts the arrangement of an apparatus according to the invention in accordance with a fourth embodiment of the present invention, and FIG. 6*b* diagrammatically depicts a functional element of a fourth embodiment of the present invention from FIG. 6*a*, and FIG. 6*c* diagrammatically depicts the arrangement of an apparatus according to the invention in accordance with a fifth embodiment of the present invention, and FIG. 6*d* diagrammatically depicts a functional element of a fifth embodiment of the present invention from FIG. 6*c*.

FIGS. 7*a* and 7*b* show further diagrammatic illustrations, in the form of an exploded view and in section, respectively, of an apparatus according to the invention in accordance with the first embodiment of the present invention from FIG. 3.

Figure 1A:
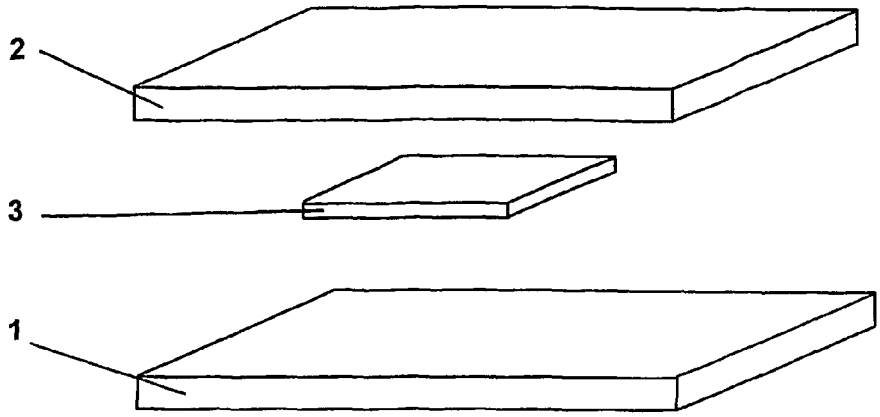
Figure 1B:
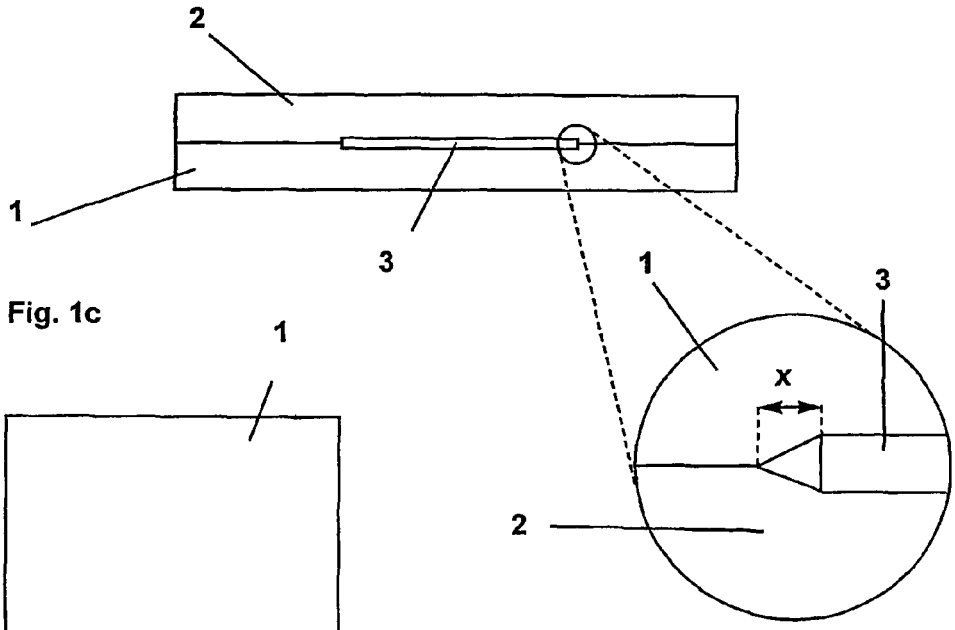

The present invention is based on the idea of providing a method for joining a first substrate layer 1, a second substrate layer 2 and a functional element 3, with the functional element 3 being elastic in form and/or being designed to be very much thinner than the first substrate layer 1 and the second substrate layer 2, and the functional element being arranged in sandwich fashion between the first substrate layer 1 and the second substrate layer 2, and the first layer 1 and second layer 2 being joined together by means of pressure, so that the functional element 3 is clamped between the two layers in such a manner that the first layer 1 and second layer 2 are permanently joined to one another and the functional element 3 is arranged permanently between the first layer 1 and the second layer 2. In this case, the first layer 1 and the second layer 2 and the functional element 3 are substantially two-dimensional in form, with the functional element 3 according to the invention having a smaller surface area than the first layer 1 one and the second layer 2.

According to the invention, in this case the pressure and the material of layer 1 and layer 2 are selected in such a manner that layer 1 and layer 2 are permanently joined to one another after the pressure has been removed.

Moreover, the method according to the invention comprises in particular the following steps, in which first of all the functional element 3 is arranged at a predetermined position on one of the layers 1 or 2, for example on the layer 1, and then a suitable solvent is applied to the surface of the layer 1 or 2 which is not covered by the functional element 3, and then the second layer 2 is arranged above the first layer 1 and the functional element 3, and then pressure is exerted on the second layer 2, so that the first layer 1 and second layer 2 are joined to one another and the functional element 3 is clamped between the layers 1 and 2.

According to the invention, in this case the material of the layers 1 and 2 and the solvent and the level and duration of the pressure are selected in such a manner that after the pressure has been removed layers 1 and 2 are permanently joined to one another.

It is appropriate for the functional element to comprise a thin plastic film and/or a metal foil.

The first layer 1 and second layer 2 expediently comprise a substrate layer made from plastic and preferably from polycarbonate and/or PPSU and/or PEI and/or melamine.

A parallel basic concept of the present invention is to provide an apparatus with channel-like structures for transporting and/or storing a liquid and/or gaseous medium, which comprises a first substrate layer 1 and a second substrate layer 2, between which is arranged a functional element 3 which is elastic in form and/or designed to be very much thinner than the first layer 1 and the second layer 2, with the channel-like structures being formed in the first layer 1 and/or the second layer 2, and the first layer 1 and the second layer 2 being fixedly and permanently joined to one another, and the functional element 3 being clamped between the first layer 1 and the second layer 2, so that the channel-like structures in the first layer 1 and/or the second layer 2 are at least partially closed off in a gastight and/or liquid-tight manner by means of the functional element 3.

An apparatus according to the invention comprises in particular a functional element 3 which is designed as a movable element, in such a manner that a channel-like structure in the first layer 1 and/or second layer 2 can be opened and/or closed by means of the functional element 3, it being possible for the functional element 3 in particular to have a valve function.

An apparatus according to the invention expediently provides a micropump, in which case the functional element 3 includes at least one valve flap 31 and the apparatus moreover comprises a dynamic drive element 4 which is suitable for altering the volume of a cavity formed in the apparatus.

An apparatus according to the invention expediently comprises a first layer 1, in which a first channel 10 is formed, and a second layer 2, in which a second channel 20 is formed, so that a connection is produced between the first channel 10 and the second channel 20. Moreover, a valve flap 31 of the functional element 3 is arranged in such a manner that the connection between the first channel 10 and the second channel 20 is opened or closed. In an apparatus according to the invention, in particular and expediently the first channel 10 and second channel 20 are arranged substantially parallel, in which case the connection between the first channel 10 and second channel 20 includes an angle $\alpha$ from 5° to 80°, preferably from 15° to 50°, with the first channel 10 and second channel 20, so that a tangential transition between the first channel 10 and second channel 20 is provided by means of the connection between the first channel 10 and second channel 20. Moreover, the valve flap 31 of the functional element 3 is expediently arranged at the location of the connection between the first channel 10 and second channel 20.

In particular and expediently, the first channel 10 has a first width 10*b*', the second channel 20 has a second width 20*b*' and the valve flap 31' has a third width 31*b*', in which case the first width 10*b*'<third width 31*b*'<second width 20*b*', and in which case a drive element 4, as seen in the direction of flow F, is connected upstream (4, 132) and/or downstream (132, 4) of the valve flap 31', thereby providing a pump structure (I).

According to a modified embodiment of the present invention, in particular and expediently an apparatus is provided having a first channel 10 with a first width 10*b*", a second channel 20 with a second width 20*b*" and a valve flap 31" with a third width 31*b*", in which case the second width 20*b*"<the third width 31*b*"<the first width 10*b*", and in which case a drive element 4 is connected upstream (4, 231) and/or downstream (231, 4) of the valve flap 31", as seen in the direction of flow F, thereby providing a pump structure (II) according to the invention.

According to the invention, a multiplicity of micropump structures (I) and/or (II) may be formed in combination in an apparatus according to the invention. In particular and expediently, an apparatus according to the invention comprises a central drive element 4, with at least one first valve flap 31', in accordance with pump structure (I), connected upstream (4, 132) of it, as seen in the direction of flow F, and moreover with at least one second valve flap 31", in accordance with pump structure (II), connected downstream (231, 4) of it, as seen in the direction of flow (F), and an apparatus according to the invention also comprises in particular a third valve flap 31', in accordance with pump structure I, which is connected downstream (132, 4) of the drive element 4, as seen in the direction of flow F, and is connected upstream of the second valve flap 31", and moreover a fourth valve flap 31", in accordance with pump structure II, which is connected upstream (231, 4) of the drive element 4, as seen in the direction of flow F, and is connected downstream of the first valve flap 31'. In this case, in particular and expediently the valve flaps 31' and 31" are formed in this arrangement in the direction of flow in a plastic film 3, and moreover a recess 30, which is connected to a cavity interacting with the drive element 4, is formed between the third and fourth valve flaps 31' and 31".

According to one particularly advantageous embodiment of the present invention, an apparatus according to the invention comprises a series connection of pump structures (I), (II), (I) and (II) with an associated first 31', second 31", third 31' and fourth 31" valve flap in this order in the direction of flow, with a central drive element 4 and a cavity (pump chamber) arranged between the middle pump structures (II) and (I). In this case, in particular and expediently the valve flaps 31' and 31" are formed in this arrangement in the direction of flow in a functional element 3. Moreover, a recess 30, which interacts with the pump chamber and the drive element 4, is formed between the two middle valve flaps 31' and 31".

According to one particularly advantageous embodiment of the present invention, an apparatus according to the invention comprises a series connection of pump structures (I), (II), (I) and (II) with an associated first, second, third and fourth valve flap 31 in this order in the direction of flow, with a central drive element 4 and a cavity (pump chamber) arranged between the middle pump structures (II) and (I). In this case, in particular and expediently the valve flaps 31 are formed in this arrangement in the direction of flow in a functional element 3. Moreover, a recess 30, which interacts with the pump chamber and the drive element 4, is formed between the two middle valve flaps 31.

According to an advantageous embodiment of the functional element 3 according to the invention, a hole structure 30' with a filter action may be provided instead of the recess 30, in which case the functional element 3 is expediently formed in a thin plastic film.

The text which follows provides a detailed description of advantageous embodiments of the present invention with reference to the accompanying drawings.

FIGS. 1*a, b, c* and *d* diagrammatically depict the basic elements of an apparatus according to the invention; these figures also illustrate the underlying principle of the method according to the invention. In the method according to the invention for joining a first substrate layer 1, a second substrate layer 2 and a functional element 3 which is elastic in form and is expediently designed to be very much thinner than the first substrate layer 1 and second substrate layer 2. Moreover, the functional element 3 is arranged in sandwich fashion between the first substrate layer 1 and second substrate layer 2, the functional element 3 having a smaller surface area than the first layer 1 and second layer 2 and expediently being arranged at a predetermined position on the first substrate layer 1. Then, a suitable solvent is applied to the surface of the substrate layer 1 which is not covered by the functional element 3. Then, the second substrate layer 2 is arranged above the first layer 1 and the functional element 3 and pressure is exerted on the second substrate layer 2, so that the first substrate layer 1 and second substrate layer 2 are joined and the functional element 3 is clamped between the substrate layers 1 and 2, with the result that the first substrate layer 1 and second substrate layer 2 are permanently joined to one another and the functional element 3 is arranged permanently between the first substrate layer 1 and the second substrate layer 2.

In this case, the material of substrate layers 1 and 2 and the solvent and the level and duration of the pressure are selected in such a manner that layers 1 and 2 are permanently joined to one another after the pressure has been removed.

Figure 1C:
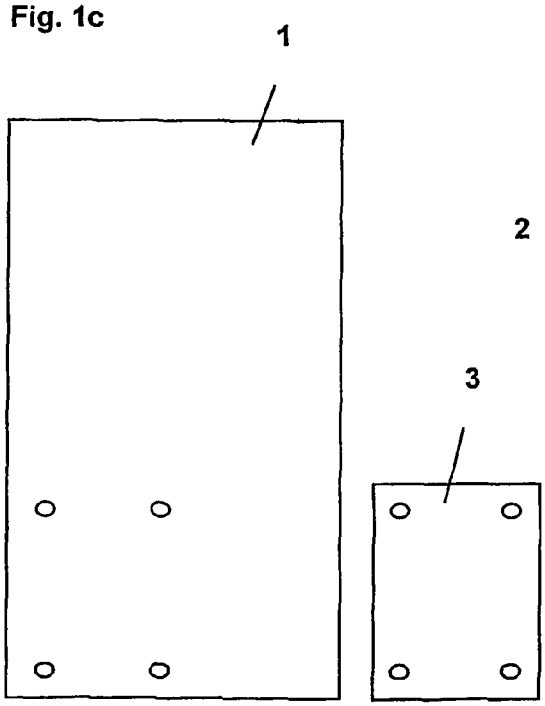
Figure 1D:
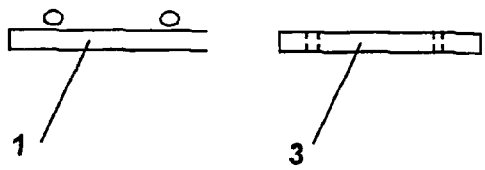

As is diagrammatically depicted in FIGS. 1*c* and *d*, positioning recesses, which interact with positioning pins on the functional element 3, may be formed in the first substrate layer 1, so that the functional element 3 can easily and accurately be arranged at a predetermined position on the substrate layer 1. It will be clear that conversely it is also possible for positioning pins to be formed on the surface of the first substrate layer 1 and positioning recesses or positioning holes which interact with the positioning pins of the substrate layer 1 to be formed on the functional element 3.

According to the invention, the functional element 3 is substantially in the form of a two-dimensional layer which is elastic in form and expediently designed to be very much thinner than the first substrate layer 1 and second substrate layer 2, and moreover the functional element 3 has a smaller surface area than the first substrate layer 1 and second substrate layer 2, and furthermore the first substrate layer 1 and second substrate layer 2 are formed from a material which can be joined by means of a suitable solvent and pressure and moreover has a sufficient elasticity for it to be possible for the functional element 3 to be clamped between the first substrate layer 1 and second substrate layer 2 by means of pressure while the surfaces of the first substrate layer 1 and second substrate layer 2 are in contact with and joined to one another and are permanently joined to one another after the pressure has been removed. In this case, the functional element 3 can be clamped between the two substrate layers 1 and 2 in such a manner that no cavities x are formed at its edges.

It is expedient for the first substrate layer 1 and second substrate layer 2 to be formed from plastic and preferably from polycarbonate and/or PPSU and/or PEI and/or melamine, and the functional element 3 is expediently a thin plastic film and/or a metal foil and is in particular formed from plastic and preferably from a polyimide.

Figure 2A:
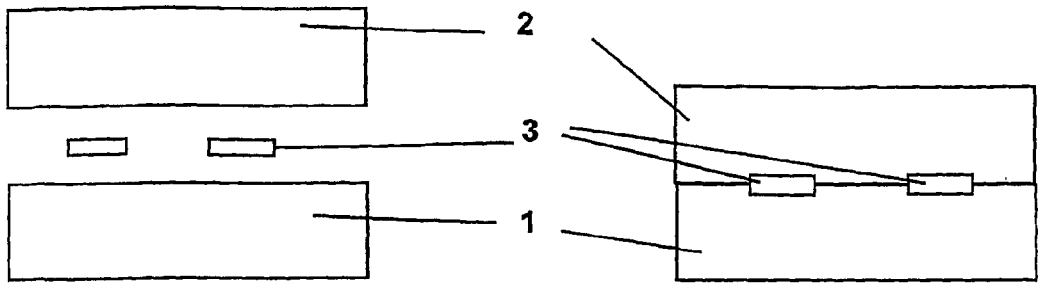

FIGS. 2*a, b* and *c* diagrammatically depict the basic elements of an apparatus according to the invention and in each case modifications to the apparatus according to the invention shown in FIG. 1. In the apparatus in accordance with FIG. 2*a*, by way of example two functional elements 3 are clamped between a first substrate layer 1 and a second substrate layer 2, in which context it will be clear that according to the invention it is also possible for a multiplicity of functional elements 3 to be clamped between a first substrate layer 1 and a second substrate layer 2 by means of the method according to the invention.

Figure 2B:
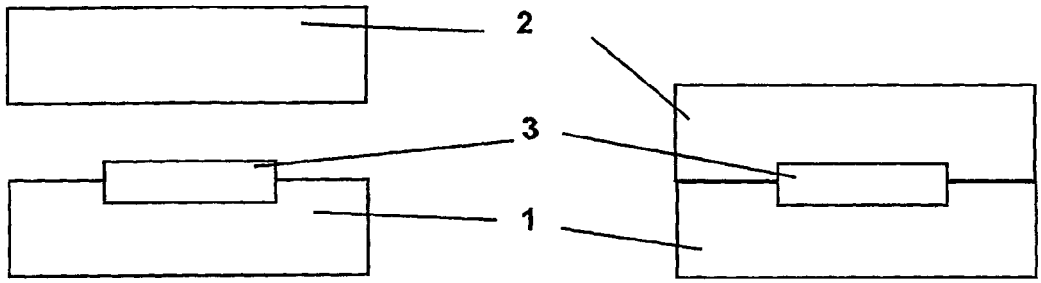

FIG. 2*b* shows the basic components of a further modification to the apparatus according to the invention shown in FIG. 1; in this figure, by way of example, only one functional element 3 is clamped between a first substrate layer 1 and a second substrate layer 2. Moreover, in the embodiment shown in FIG. 2, the first substrate layer 1 is pretreated in such a manner, i.e. a suitable recess formed in the surface of substrate layer 1, that the functional element 3 can be arranged in an accurate position in the recess. Moreover, in the embodiment shown in FIG. 2*b*, it is possible for the functional element 3 to be thicker than a functional element 3 of the embodiment shown in FIG. 1 and FIG. 2*a*. The functional element 3 of the embodiment shown in FIG. 2*b* expediently has a thickness which is greater than or equal to the depth of the recess in the substrate layer 1.

Figure 2C:
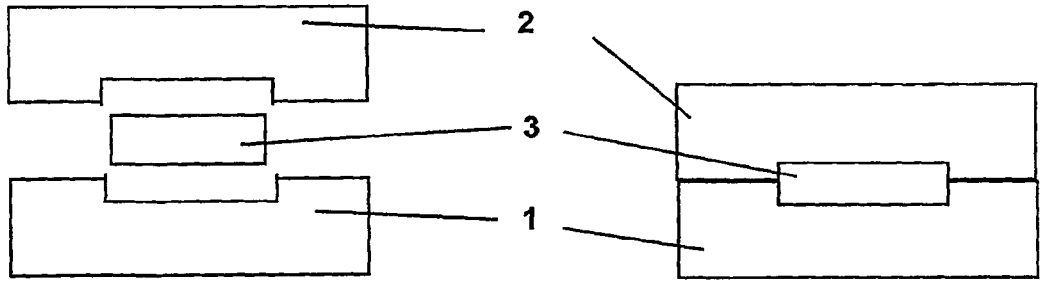

FIG. 2*c* diagrammatically depicts the main components of a further modification to an apparatus according to the invention, in which case a suitable recess is formed in the second substrate layer 2 as well, in a corresponding position to the recess in the substrate layer 1 and the functional element 3. In the embodiment shown in FIG. 2*c*, the functional element 3 may have a greater thickness than the functional element 3 of the embodiments shown in FIGS. 1, 2*a* and 2*b*, in which case the thickness of the functional element 3 is expediently greater than or equal to the sum of the depths of the recesses in the substrate layers 1 and 2.

It will be clear that further modifications to an apparatus according to the invention and the method according to the invention can also be provided by combinations of the embodiments shown in FIGS. 1, 2*a*, 2*b* and 2*c*.

The following figures diagrammatically depict the main components of an apparatus according to the invention in accordance with further embodiments of the present invention, with a basic arrangement of the embodiment shown in FIG. 1 having been selected, in which there are no recesses for positioning the functional element 3 formed in the two opposite substrate layers 1 and 2. It will be clear that the embodiments described below can also be provided in a corresponding form to the embodiments of FIGS. 2*b* or 2*c* described above and that the respective functional elements 3 and/or substrate layers 1 and/or 2 may also have positioning formations as described with reference to FIG. 1 and 2.

Figure 3A:
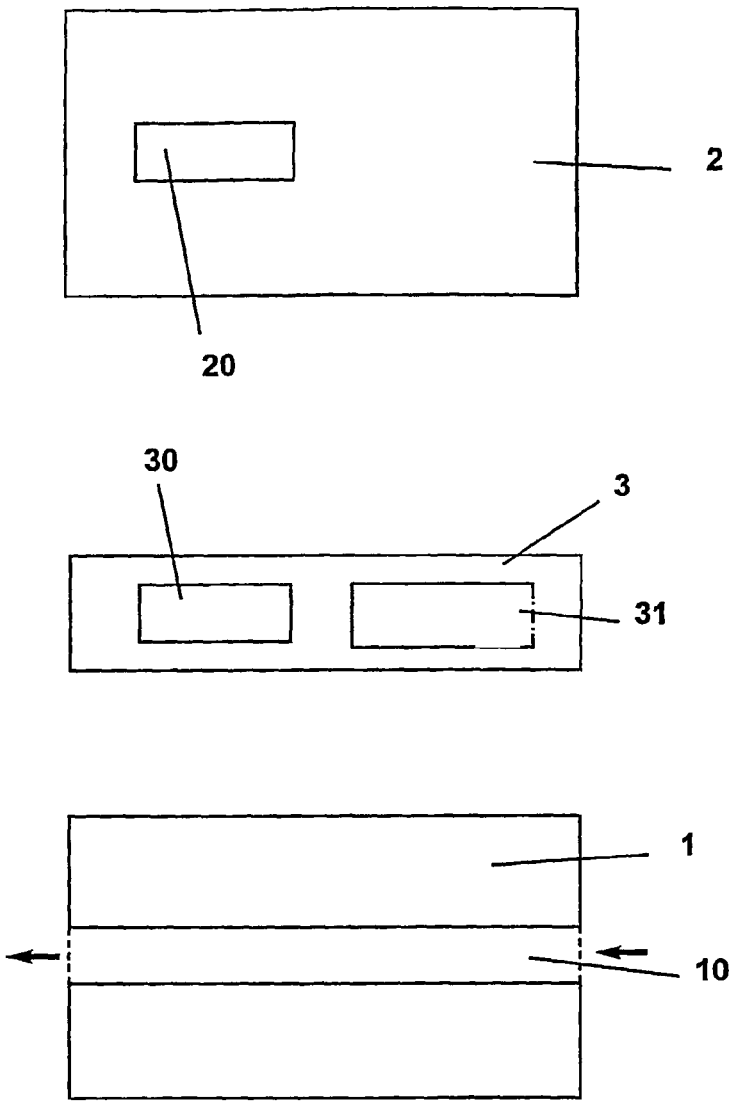
Figure 3B:
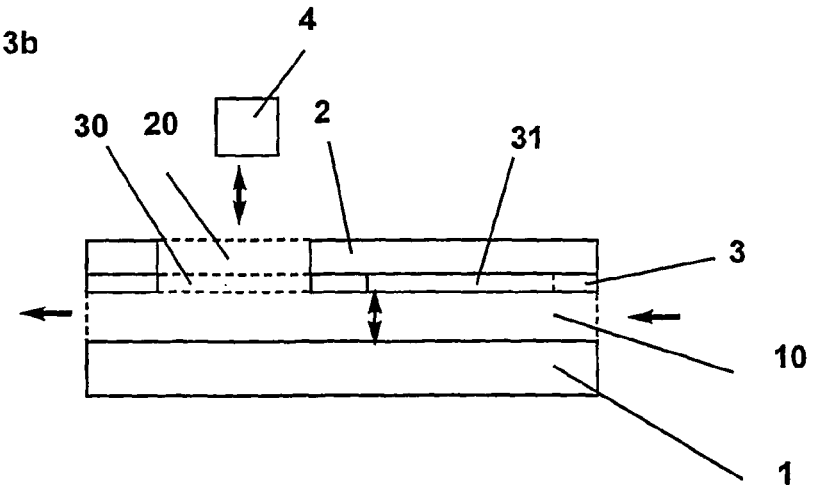

FIG. 3*a* shows a plan view of the main components of an apparatus according to the invention in accordance with a first embodiment of the present invention, and FIG. 3*b* shows a section through components of FIG. 3*a* arranged on top of one another.

The first embodiment of the present invention as shown in FIG. 3*a* provides an apparatus having channel-like structures for transporting and/or storing a liquid and/or gaseous medium, the apparatus comprising a first substrate layer 1 and a second substrate layer 2 and a functional element 3 which is elastic in form and is expediently designed to be very much thinner than the first substrate layer 1 and second substrate layer 2 and which is arranged in sandwich fashion between the first substrate layer 1 and second substrate layer 2. Moreover, channel-like structures 10 and 20 are formed in the first substrate layer 1 and/or the second substrate layer 2, and the first substrate layer 1 and second substrate layer 2 are fixedly and permanently joined to one another, with the functional element 3 being clamped between the first substrate layer 1 and second substrate layer 2 in such a manner that the channel-like structures 10 and 20 in the first substrate layer 1 and/or second substrate layer 2 are closed off at least in a gastight and/or liquid-tight manner by means of the functional element 3. According to the invention, in the embodiment shown in FIG. 3, a channel 10 which is open at the top is formed in the first layer 1, and a continuous opening 20 which passes all the way through the layer 2 and interacts with the channel 10 is formed in the second layer 2. Moreover, according to the invention the functional element 3 is designed as a thin film with a through-opening 30 which interacts with the opening 20 in the second substrate layer 2, and is also designed with a valve flap 31, the width and length of which correspond to the width and depth of the channel 10.

According to the invention, the layers 1 and 2 are now arranged one above the other, and moreover the functional element 3 is arranged in sandwich fashion between the substrate layers 1 and 2, in such a manner that the channel 10 is connected to a cavity interacting with a drive element 4 by means of the opening 30 and 20, and moreover the channel 10 can be opened and/or closed by means of the valve flap 31, so as to provide a pump structure according to the invention.

The pump structure described above is diagrammatically depicted in FIG. 3*b*. The drive element 4 may, for example and expediently, be provided by means of a piezo actuator 4. In the embodiment shown in FIG. 3*b*, by way of example, the opening 30 and 20 and the drive element 4 are connected downstream of the valve flap 31 as seen in the direction of flow (arrow direction). It will be clear that the opening 20 and 30 and the drive element 4, given a suitable design of the valve flap 31, may also be connected upstream of the latter as seen in the direction of flow, and/or in each case second openings 20 and 30 in addition to the openings 20 and 30 shown in FIGS. 3*a* and 3*b* and a second drive element 4 in addition to the drive element 4 connected downstream of the valve flap 31 may be connected upstream of the valve flap 31.

Expediently and advantageously, it is also possible for a hole structure 30', which has a filter action and effectively prevents any contaminating or dirt particles contained in a liquid that is to be pumped from entering the cavity or the pump chamber, to be formed in the functional element 3 instead of the opening 30. An advantageous hole structure 30' of this type is diagrammatically depicted in FIG. 8 and is described in more detail below.

Figure 4A:
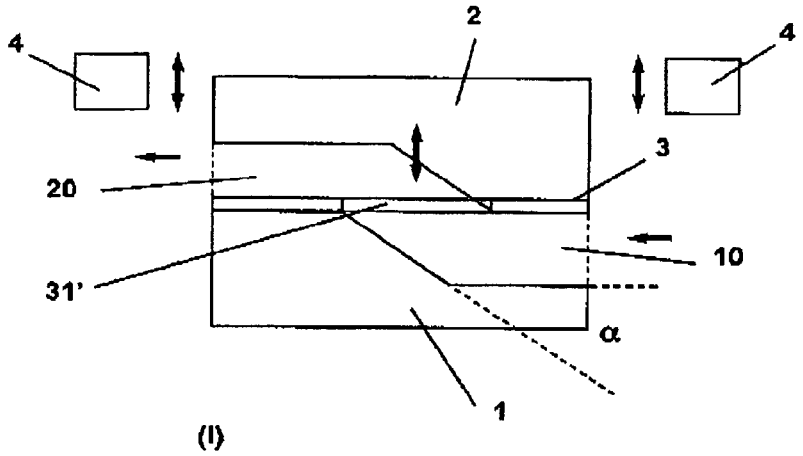
Figure 4B:
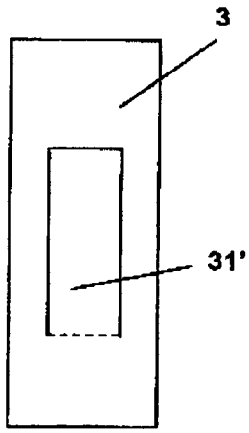
Figure 4C:
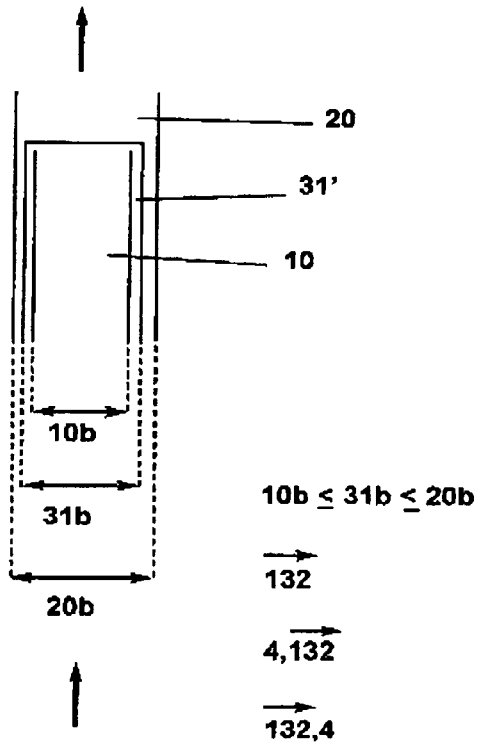

FIG. 4*a* shows a partial section through components of an apparatus according to the invention, arranged on top of one another, in accordance with a second embodiment of the present invention, and FIG. 4*b* shows a plan view and FIG. 4*c* a partial plan view of a functional element of the second embodiment of the present invention from FIG. 4*a*.

The second embodiment of the present invention as shown in FIG. 4 substantially corresponds to the embodiment shown in FIG. 3, except that the channel 10 in the first layer shallows out at a predetermined position with a predetermined angle α, and moreover a second channel 20, which likewise shallows out at a predetermined position and at a predetermined angle α and interacts with the channel 10 formed in the first substrate layer 1 in such a manner that when the substrate layers 1 and 2 are arranged on top of one another a tangential connection between the channels 10 and 20 at a predetermined angle α is provided, is formed in the second substrate layer 2. Moreover, the channel 20 is designed in such a manner that at a predetermined position (not shown in the drawing), it is connected to a cavity which is arranged above the layer 2 and interacts with a drive element 4.

The functional element 3 of the embodiment shown in FIG. 4 substantially corresponds to the functional element 3 from the embodiment shown in FIG. 3, except that the functional element 3 of the embodiment shown in FIG. 4 does not include an opening 30.

The first channel 10 and the second channel 20 and the functional element 3 with the valve flap 31' according to the invention are now designed in such a manner that the valve flap 31' is arranged at the location of the connection between the first channel 10 and the second channel 20, in such a manner that the connection between the first channel 10 and the second channel 20 is opened or closed by interaction with a drive element 4 which may be connected upstream and/or downstream of the valve flap 31'. According to the invention, the first channel 10, the second channel 20 and the valve flap 31' are designed in such a manner that the first channel 10 has a first width 10*b*', the second channel 20 has a second width 20*b*' and the valve flap 31' has a third width 31*b*', so that the first width 10*b*'<the third width 31*b*', and the third width 31*b*'<the second width 20*b*'. Moreover, it is expedient for the valve flap 31' to be arranged and formed in such a manner that a pump structure with a direction of flow (arrow direction) from the first channel 10 to the second channel 20 is provided, it being possible for the drive element 4 to be connected upstream (4, 132) and/or downstream (132, 4) of the valve flap 31', as seen in the direction of flow F. The embodiment described above in accordance with FIG. 4*a* provides a pump structure (I) according to the invention.

Figure 5A:
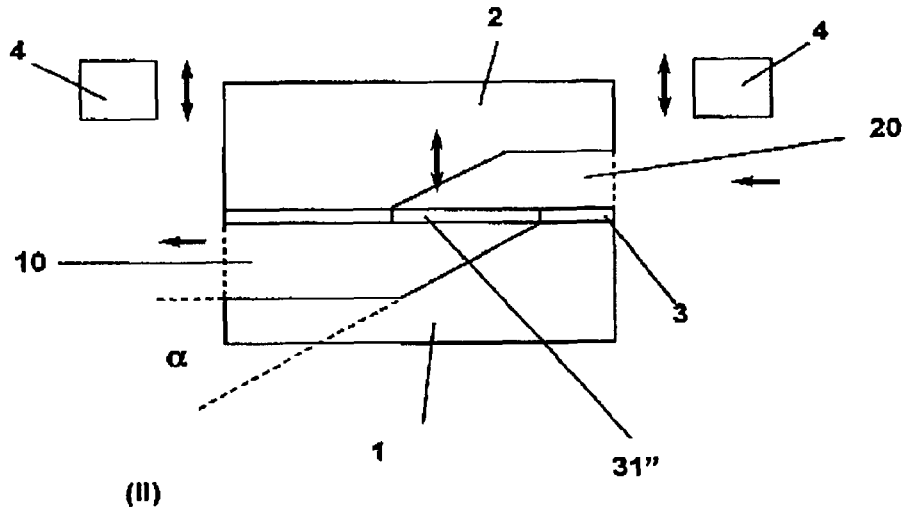
Figure 5B:
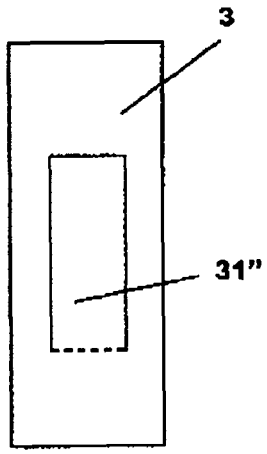
Figure 5C:
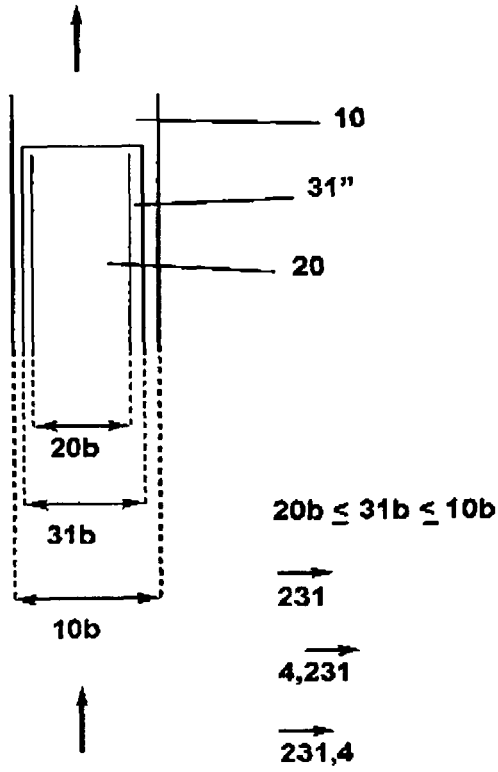

FIG. 5*a* shows a partial section through components, arranged on top of one another, of an apparatus according to the invention in accordance with a third embodiment of the present invention, and FIGS. 5*b* and 5*c* respectively show a plan view and a partial plan view of a functional element 3 of the third embodiment of the present invention from FIG. 5*a*.

The third embodiment of the present invention shown in FIG. 5 in principle substantially corresponds to the second embodiment of the present invention in accordance with FIG. 4, except that the channels 10 and 20 and the functional element 3 with the valve flap 31" are designed and arranged in such a manner as to provide a pump with a direction of flow (arrow direction) from channel 20 to channel 10. In this case, the channels 10 and 20 expediently have a first width 10*b*" and a second width 20*b*", respectively, and the valve flap 31" has a third width 31*b*", so that the second width 20*b*"<the third width 31*b*", and the third width 31*b*"<the first width 10*b*". It will be clear that in the third embodiment shown in FIG. 5 a drive element 4 may likewise be connected upstream (4, 231) and/or downstream (231, 4) of the valve flap 31, as seen in the direction of flow F. The third embodiment of the present invention provides a pump structure (II) according to the invention.

For both embodiments of the present invention, namely the embodiments shown in FIGS. 4 and 5, the angle α expediently includes an angle of from 5° to 80°, preferably from 15 to 50° and particularly advantageously an angle which is such that a tangential transition is provided between the two channels 10 and 20.

Figure 6A:
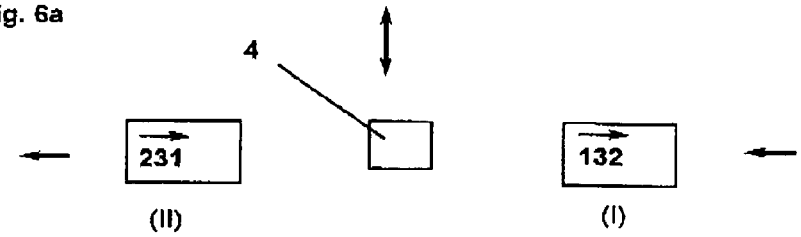

FIG. 6*a* diagrammatically depicts the arrangement of an apparatus according to the invention in accordance with a fourth embodiment of the present invention.

Figure 6B:
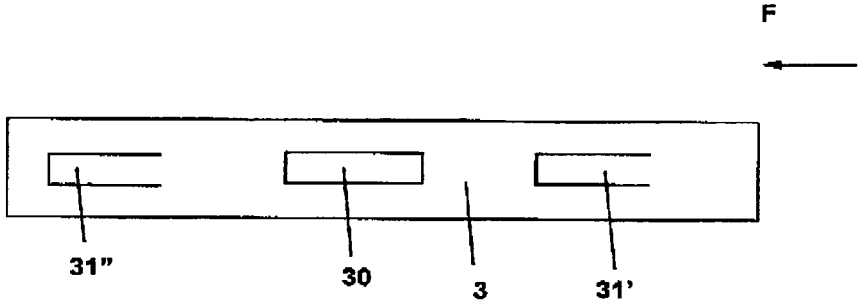

According to the invention, in the fourth embodiment of the present invention shown in FIG. 6*a*, at least one first valve flap 31' in accordance with the pump structure (I) shown in FIG. 4 is connected upstream of a central drive element 4, as seen in the direction of flow (F), and moreover at least one second valve flap 31" in accordance with the pump structure (II) from FIG. 5 is connected downstream of the central drive element 4, as seen in the direction of flow F. In the fourth embodiment of the present invention, the pump structure (I) and the pump structure (II) can in each case be provided by means of independent functional elements 3 and their valve flaps 31' and 31". The pump structures (I) and (II) may expediently also be provided by means of a suitably designed, single-piece functional element 3 with a central through-opening 30 which has a valve flap 31' connected upstream of it as seen in the direction of flow F, in accordance with the embodiment shown in FIG. 4, and with a valve flap 31" in accordance with the embodiment shown in FIG. 5 connected downstream of the through-opening 30, as seen in the direction of flow F. A functional element 3 according to the invention of this type is diagrammatically depicted in FIG. 6*b*, which shows a suitable single-piece functional element 3 with a central continuous recess 30, which has a valve flap element 31' connected upstream of it as seen in the direction of flow (arrow direction), in accordance with the embodiment shown in FIG. 4(I), and a valve flap 31" connected downstream of it, as seen in the direction of flow F, in accordance with the embodiment shown in FIG. 5(II). It is also possible for a hole structure 30', in accordance with the functional element 3 shown in FIG. 8, which is described below, to be expediently and advantageously formed in the functional element 3 instead of the opening 30.

Figure 6C:
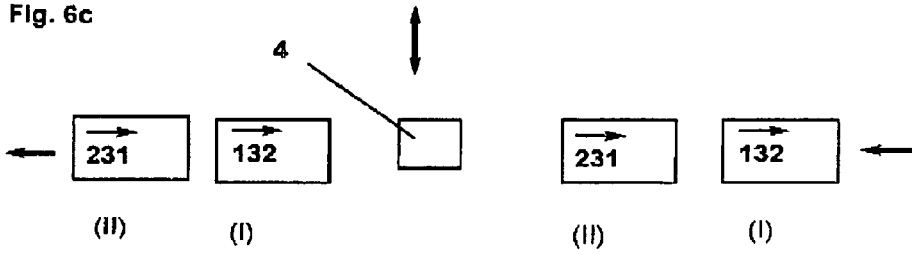

FIG. 6*c* diagrammatically depicts the arrangement of an apparatus according to the invention in accordance with a fifth embodiment of the present invention, in which likewise, as in the fourth embodiment of the present invention from FIG. 6*a*, a first pump structure (I) in accordance with the embodiment shown in FIG. 4 is connected upstream of a central drive element 4, as seen in the direction of flow (F), and a second pump structure (II) in accordance with the embodiment shown in FIG. 5 is connected downstream of the drive element 4, as seen in the direction of flow F, and in which, moreover, a third pump structure (II) in accordance with the embodiment shown in FIG. 5 is connected upstream of the central drive element 4, as seen in the direction of flow, and is connected downstream of the first pump structure (I), as seen in the direction of flow, and in which, moreover, a fourth pump structure (I) in accordance with the embodiment shown in FIG. 4 is connected downstream of the central drive element 4 and is connected upstream of the first pump structure (II) in accordance with FIG. 5.

When the fifth embodiment of the present invention shown in FIG. 6*c* is in operation, a liquid flows through a channel 10 in the first substrate layer 1, through a pump structure (I) and a channel 20 in the second substrate layer 2, a pump structure (II) and a channel 10 in the first substrate layer 1, a further pump structure (I) and a channel 20 in the second substrate layer 2, and finally through a further pump structure (II) and a channel 10 in the first substrate layer 1.

Figure 9:
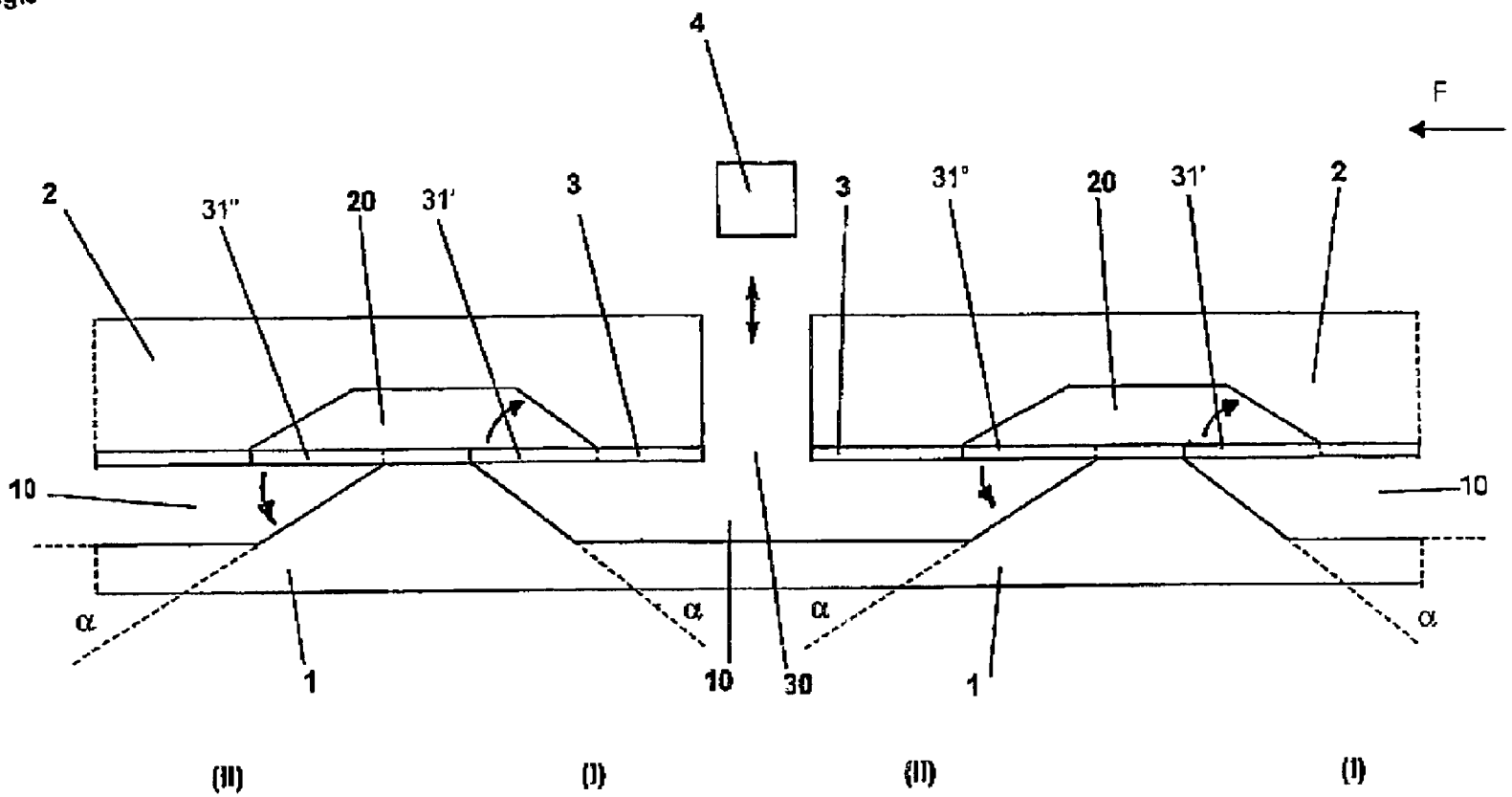
FIG. 9 shows a diagrammatic section through an apparatus according to the invention in the arrangement from FIG. 6*c*.

In the fifth embodiment of the present invention shown in FIG. 6*c*, the four pump structures (I) and (II) may be provided by individual functional elements 3 which interact with the central drive element 4. The respective valve flaps 31' and 31" are expediently and in accordance with the invention provided by a single-piece functional element 3, which in its central region has a continuous recess 30, in each case two valve flaps 31, in accordance with the embodiments of the pump structures (II) and (I), being connected upstream and downstream of the recess 30, as seen in the direction of flow. FIG. 9 shows a diagrammatic section through the fifth embodiment of the present invention shown in FIG. 6*c*.

Figure 6D:
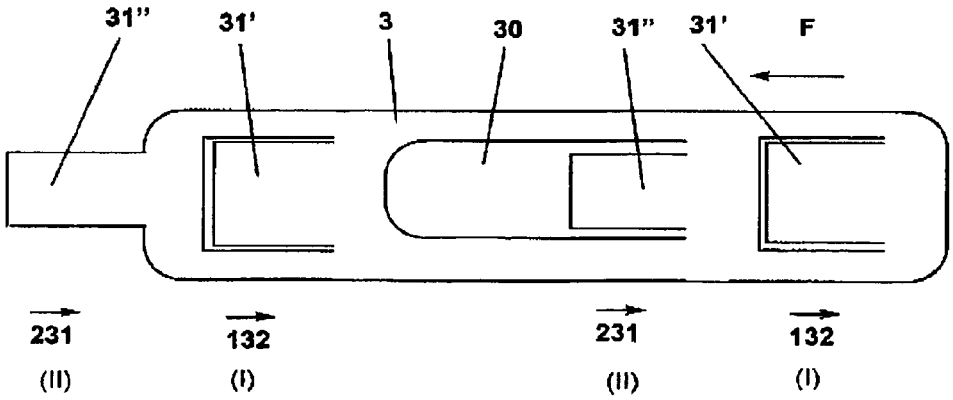

An advantageous functional element 3 of this type is diagrammatically depicted in FIG. 6*d* and in each case comprises valve flaps 31' and 31" in accordance with the pump structures (I), (II), (I) and (II), which are connected in series in this order as seen in the direction of flow F, with the central recess 30 arranged between the valve flaps 31' and 31" of the middle pump structures (II) and (I). It is also possible for a hole structure 30' in accordance with the functional element 3 shown in FIG. 8, which is described below, to be expediently and advantageously formed in the functional element 3 instead of the opening 30.

Figure 7A:
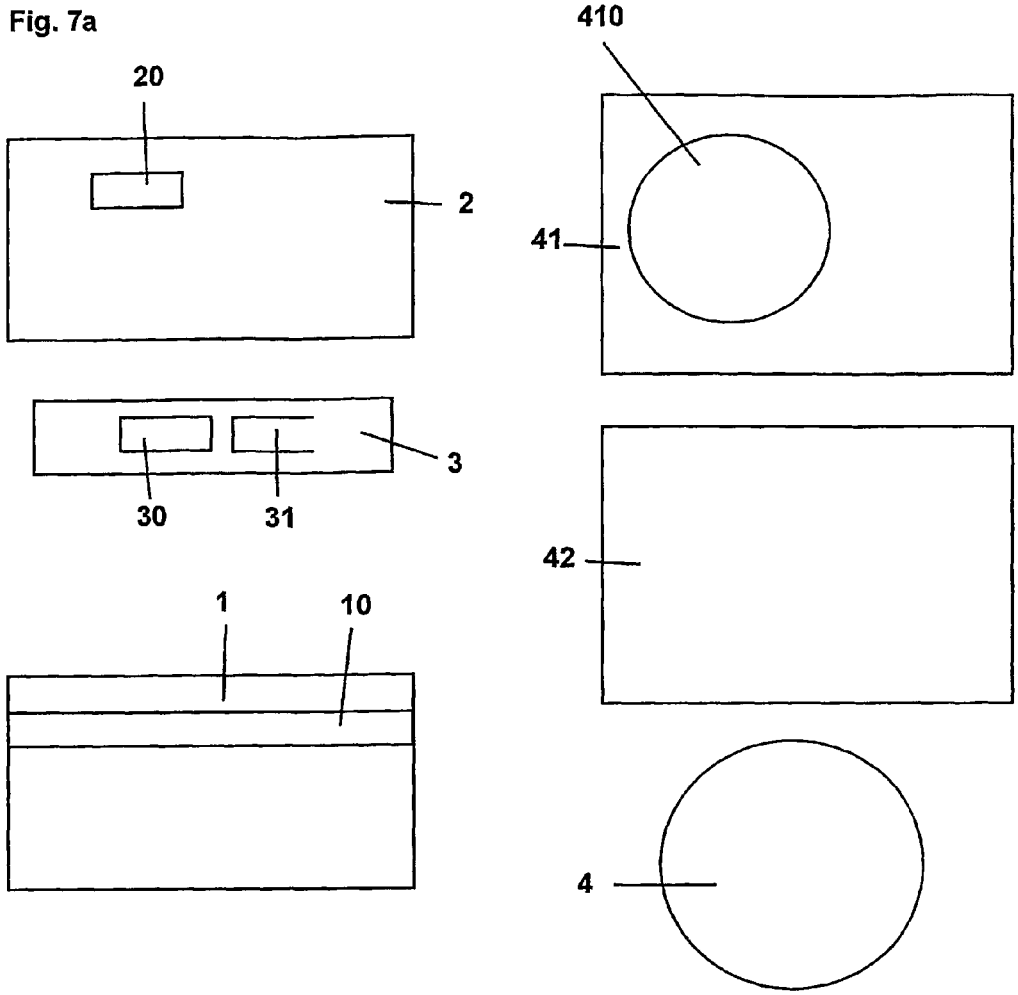

FIG. 7*a*, by way of example, diagrammatically depicts an apparatus according to the invention of the first embodiment of the present invention having a channel 10, which is formed in the first substrate layer 1, and a functional element 3 with a continuous recess 30 or a hole structure 30', with a valve flap 31 connected upstream of it, and a second substrate layer 2 with a continuous recess 20, which interacts with a cavity 410 formed in a third substrate layer 41. The structure and action of the embodiment shown in FIG. 7*a* corresponds to the embodiment shown in FIG. 3, and consequently reference is made at this point to the description given in connection with FIG. 3. The layers 1 and 2 are arranged above one another, and the functional element 3 is arranged in sandwich fashion between the layers 1 and 2. The fourth layer 41 with the cavity 410, which comprises a pump chamber, is arranged above the second layer 2 and is covered with a thin glass layer 42, above which is arranged a drive element 43 which is provided in a suitable way by means of a piezo actuator 4. It is expedient for the opening 20 in the second layer and the cavity 410 in the layer 41 to be formed and arranged in such a manner that the opening 20 in the second layer is arranged at an apex of the cavity 410 in the substrate layer 41. This minimizes the penetration of air bubbles into the cavity 410 when the present invention is used as a liquid pump.

Forming the cavity 410 in a substrate layer 41, which is arranged above the second substrate layer 20, and the advantageous arrangement thereof, have been described by way of example on the basis of the embodiment shown in FIG. 7*a* and FIG. 3, and can likewise advantageously be applied to the other embodiments of the present invention. It will become clear that the inlet and outlet of channels 10 in the first substrate layer may be arranged in any desired way, for example on opposite sides, parallel or at an angle.

Figure 7B:
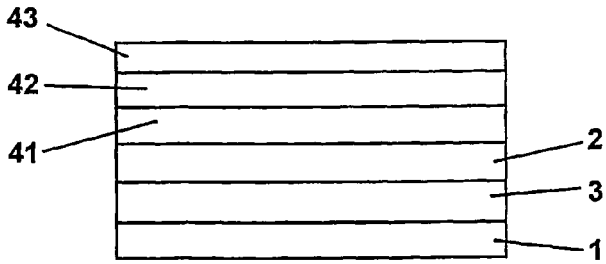

Moreover, it will be clear that the above-described second to fifth embodiments of the present invention can advantageously be combined in a corresponding way with a drive element 43 and the further elements or layers 4, 41, 410, 42 and 43 in accordance with FIG. 7.

The drive element 4 may expediently be a thin piezo diaphragm.

The present invention may in particular be produced at low cost, even in industrial series production, in miniaturized form by means of microstructuring techniques.

Figure 8:
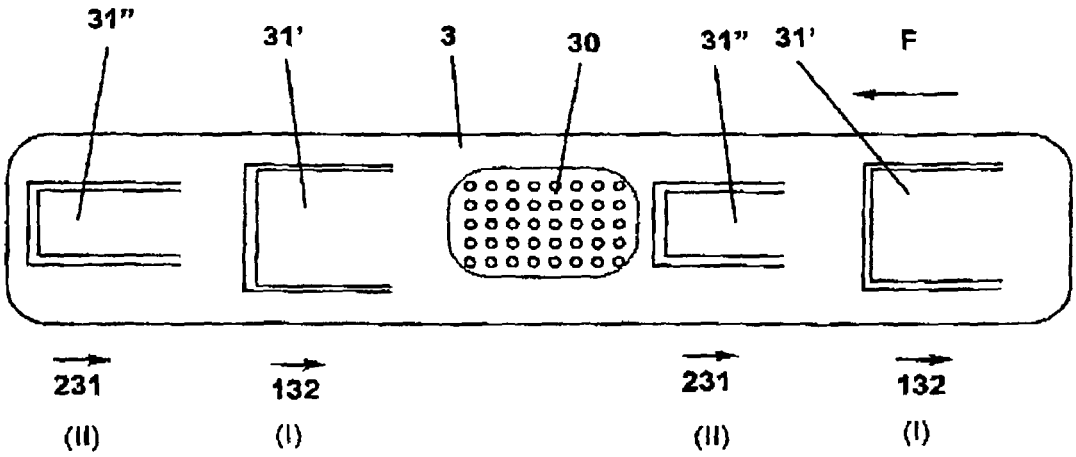
FIG. 8 shows an advantageous modification to the functional element shown in FIG. 6*d*.

FIG. 8 diagrammatically depicts an advantageous modification to the single-piece functional element 3 according to the invention shown in FIG. 6*d*, which expediently comprises a thin plastic film. The functional element 3 also comprises valve flaps 31' and 31" in accordance with the pump structures (I), (II), (I) and (II), which are formed in this order in a plastic film and are arranged in the direction of flow F. A hole structure 30', which interacts with the cavity 410 of a pump chamber, is expediently and advantageously formed between the middle pump structures (II) and (I). The hole structure in this case has the effect of a filter which effectively prevents any contaminating or dirt particles contained in a liquid that is to be pumped from penetrating into the pump chamber 410 and thereby effectively prevents associated disruptions to the operation of the drive element 4. Consequently, any particles contained in the liquid that is to be pumped are passed completely through the fluid channel and do not reach the pump chamber, which means that a piezo diaphragm 4 can continue to move unimpeded. As a result, the demands imposed on the purity of a liquid which is to be pumped are advantageously determined solely by the channel cross section of the channel structures 10 and 20, which may, for example, be approximately $1mm^2$.

Figure 10:
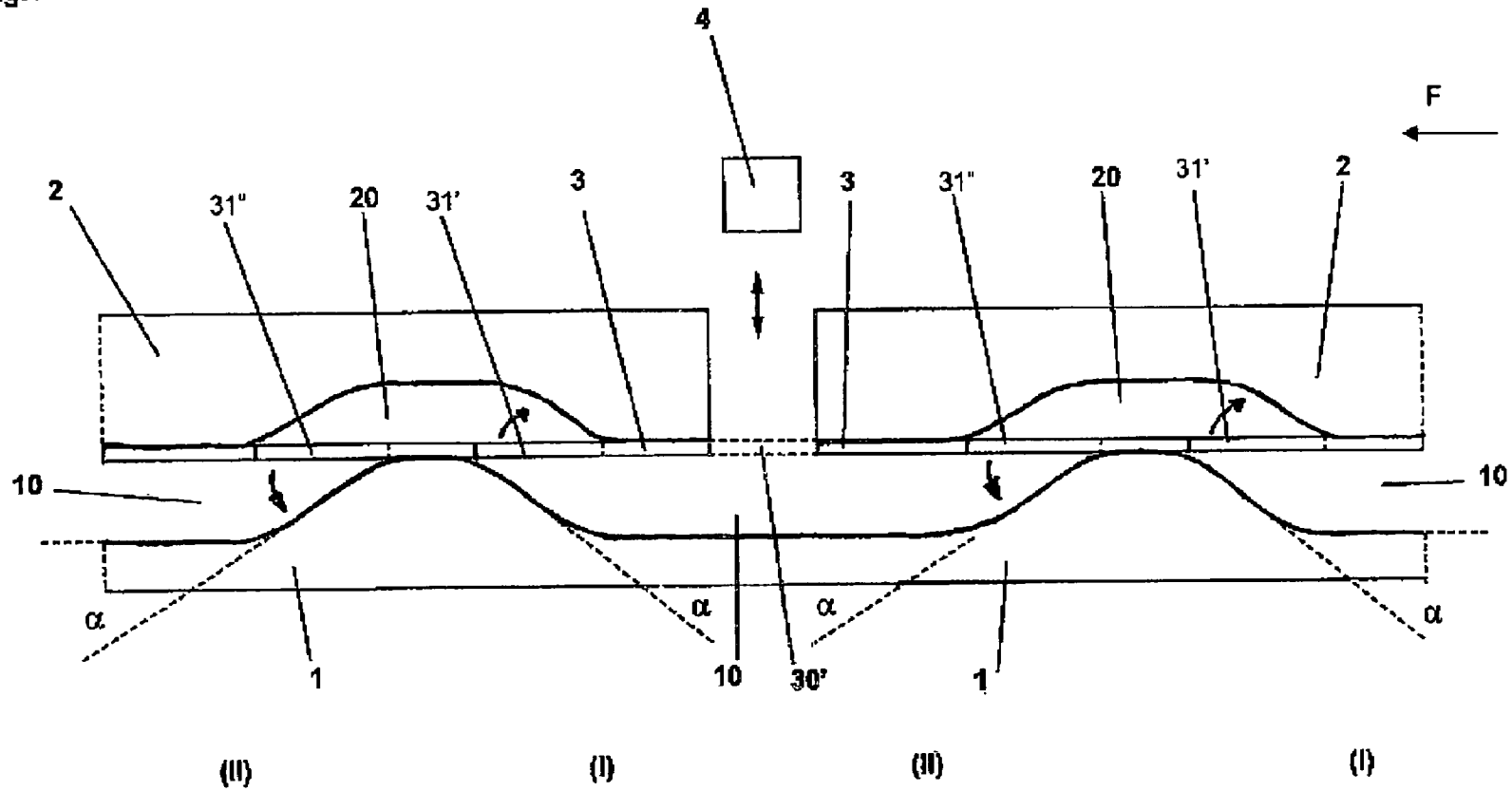
FIG. 10 shows an advantageous modification to the apparatus according to the invention from FIG. 9.

The above-described advantageous hole structure 30' of the functional element 3 particularly advantageously interacts with a multiple valve arrangement in accordance with FIG. 6*c*, FIGS. 9 and 10, in which case even elongate fibrous particles pass through a pump according to the invention without causing any problems.

FIG. 9 shows a diagrammatic section through an apparatus according to the invention in accordance with the fifth embodiment of the present invention, which has been described in detail above with reference to FIG. 6*c*. The fifth embodiment of the invention is particularly suitable for a single-piece functional element 3 in accordance with FIG. 6*d*, which is illustrated by way of example in FIG. 9 and is particularly advantageously suitable for a functional element 4 as shown in FIG. 8.

The advantageous series connection of the pump structures (I), (II), (I) and (II) in this order in the direction of flow F, with the respective valve flaps 31' and 31" and the associated channel structures 10 and 20 in the upper substrate layer 1 and lower substrate layer 2 and the central drive element 4 arranged between the middle pump structures (II) and (I) and having the central pump chamber promotes a particularly efficient pump capacity in particular on account of the arrangement at an angle α with in particular a tangential transition between the channel structures 10 and 20.

FIG. 10 shows an advantageous modification to the fifth embodiment of the present invention from FIG. 6*c* and FIG. 9, which substantially corresponds to the fifth embodiment described above with reference to FIG. 6*c* and FIG. 9, except that the transition between the channel structures 10 and 20 is advantageously designed to be continuous without any steps, sharp edges or corners, which significantly increases the efficiency of the pumping capacity still further and also further reduces the susceptibility to problems caused by contaminating or dirt particles to a considerable extent, in particular in combination with the functional element 3 from FIG. 8 with the hole structure 30' which is used advantageously and by way of example here.

In particular the single-piece formation of the functional element 3 and its multi-functional role as a filter and with a plurality of differently designed and similar valve flaps 31 is particularly advantageous since it is particularly efficient in terms of performance and action in particular with suitable channel structures 10 and 20, and moreover it can be produced and assembled in miniaturized form in a simple and inexpensive way even in large numbers.

A first to fifth embodiment, as described above, of a micropump according to the invention, and in particular the fourth and fifth embodiments of the invention, are particularly suitable for delivering liquids and gases even in extremely small metered quantities, and given a suitably miniaturized formation may have a particle tolerance up to a particle diameter of approx. 40 μm. On account of the structure of the fluid channel according to the invention with gradual angles and the integrated valve flaps, moreover only an extremely minor pressure loss can occur in operation.

Moreover, it will be clear that a micropump according to the invention can be used in many sectors, for example for the metering of fluids in chemical, biological and medical analysis, for example for sampling, e.g. in environmental analysis, and also, for example, in the food industry, for cooling systems, for transport purposes for example in lubricating systems or for dispensing purposes, etc.

The invention claimed is:

1. An apparatus with channel-like structures for transporting and or storing a liquid medium, comprising:

a first substrate layer (1); and a second substrate layer (2); and a functional element (3) which is arranged in sandwich fashion between the first substrate layer (1) and the second substrate layer (2), wherein the channel-like structures are formed in the first substrate layer (1) and the second substrate layer (2);

the first substrate layer (1) and second substrate layer (2) are fixedly and permanently joined to one another, and the functional element (3) is clamped between the first substrate layer (1) and second substrate layer (2);

the functional element (3) is elastic in form;

the first layer (1) and second layer (2) are rigid in form;

the channel-like structures in the first substrate layer (1) and second substrate layer (2) are at least partially closed off in a fluid-tight manner by means of the functional element (3);

the functional element (3) is formed to be very much thinner than the first layer (1) and second layer (2);

the functional element (3) is formed as at least one functional movable element, in such a manner that the channel-like structures (10, 20) are opened or closed by means of the functional element (3);

the functional element (3) comprises at least one valve flap (31',31");

the apparatus further comprises a dynamic drive element (4) for altering the volume of a cavity (410) formed in the apparatus;

a first channel (10) is formed in the first layer (1);

a second channel (20) is formed in the second layer (2), so that a connection is formed between the first channel (10) and the second channel (20);

the at least one valve flap (31',31") of the functional element (3) is arranged in such a manner that the connection between the first channel (10) and the second channel (20) is opened or closed;

the first channel (10) and second channel (20) are arranged parallel to each other; and the connection between the first channel (10) and the second channel (20) forms an angle (α) between 15° and 50°, whereby a tangential transition which is formed to be continuous without any steps, sharp edges or corners between the first channel (10) and second channel (20) is provided by means of the connection between the first channel (10) and second channel (20).

2. The apparatus as claimed in claim 1, wherein said drive element (4) is arranged as a central drive element with the at least one first valve flap (31') arranged upstream (4, 132) thereof in the direction of flow (F); and the at least one second valve flap (31") is arranged downstream (231, 4) thereof in the direction of flow (F).

3. The apparatus as claimed in claim 2, further comprising a third valve flap (31') arranged downstream (132, 4) of the drive element (4) and upstream of the second valve flap (31"), in the direction of flow (F); and a fourth valve flap (31") arranged upstream (231,4) of the drive element (4) and downstream of the first valve flap (31'), in the direction of flow (F).

4. The apparatus as claimed in claim 3, wherein the first (31'), second (31"), third (31') and fourth (31") valve flaps are arranged along the direction of flow (F) in the functional element (3), and also a recess (30), which is connected to the cavity (410) interacting with the drive element (4), is formed in the functional element (3) between the second (31") and third (31') valve flap.

5. The apparatus as claimed in claim 4, wherein the drive element (4) comprises the cavity (410) which is provided by means of a further substrate layer (41) having a central recess (410) above which a layer (42) with a predetermined rigidity and a piezo element (43) are arranged, and an opening (20) in the second layer (2) is arranged at a vertex of the cavity (410) in the substrate layer (41), wherein the functional element (3) is a single-piece element which is formed in a thin plastic film and has the valve flaps (31', 31") and a central hole structure (30') which is formed as a filter element, which interacts with the cavity of a pump chamber.

6. The apparatus as claimed in claim 1, wherein the first channel (10) has a first width (10*b*'); the second channel (20) has a second width (20*b*'); and a first valve flap (31') has a third width (31*b*'); and the following relationship applies: first width (10*b*') <third width (31*b*') <second width (20*b*');

in which, in the direction of flow (132), the drive element (4) is connected at least one out of upstream (4, 132) and downstream (132,4) to the first valve flap (31), in the direction of flow (F).

7. The apparatus as claimed in claim 1, wherein the first channel (10) has a first width (10*b*"); the second channel (20)

has a second width (20*b*"); and a second valve flap (31") has a third width (31*b*"); and the following relationship applies:

second width (20*b*") <third width (31*b*") <first width (10*b*"); the drive element (4) being connected at least one out of upstream (4, 231) and downstream (231, 4) to the second valve flap (31"), in the direction of flow (F).

* * * * *